United States Patent [19]

Wurster

[11] 4,322,868

[45] Apr. 6, 1982

[54] SEWER AND CATCH BASIN CLEANER

[75] Inventor: James C. Wurster, West Allis, Wis.

[73] Assignee: Super Products Corporation, New Berlin, Wis.

[21] Appl. No.: 186,235

[22] Filed: Sep. 11, 1980

[51] Int. Cl.[3] ..... B08B 3/02

[52] U.S. Cl. ..... 15/302; 15/340; 15/352; 15/353; 134/168 C

[58] Field of Search ..... 15/302, 304, 314, 320, 15/321, 340, 353; 134/167 C, 168 R, 168 C; 414/519

[56] References Cited

U.S. PATENT DOCUMENTS

| | | | |
|---|---|---|---|
| 3,369,685 | 2/1968 | Price et al. | 414/519 X |
| 3,847,293 | 11/1974 | Boon | 15/340 X |
| 3,910,497 | 10/1975 | Manor | 134/168 C X |
| 4,134,174 | 1/1979 | Flynn et al. | 15/302 |
| 4,199,837 | 4/1980 | Fisco | 15/302 |
| 4,207,647 | 6/1980 | Masters | 15/302 |

*Primary Examiner*—Chris K. Moore

[57] ABSTRACT

A sewer and catch basin cleaner includes a system for injecting water under pressure into a sewer for cleaning same and a vacuum loading system for removing water and debris from the sewer catch basin. The cleaner includes a water storage tank for providing the cleaning water and a body for receiving the material removed from the catch basin or manhole. A water reclamation system is provided for replenishing the water tank from the body to facilitate uninterrupted operation of the device. The cleaner further includes a system for directing water from the body to the catch basin when sufficient water is in the water tank and a sensing arrangement for automatically keeping the desired amount of water in the respective containers. The body of the sewer cleaner of the present invention also includes a tailgate and an ejector plate for pushing debris from the body when cleaning is completed or when the body is full of debris. The ejector plate and tailgate are interconnected so that the tailgate is automatically raised as the ejector plate moves from the front toward the rear of the body. The tailgate includes an air pressurized seal to insure proper sealing to the body.

12 Claims, 4 Drawing Figures

SEWER AND CATCH BASIN CLEANER

FIELD OF THE INVENTION

The present invention relates generally to the art of sewer cleaning and more particularly to mobile sewer and catch basin cleaners of the type which include systems for injecting water under pressure into sewer laterals and for vacuum loading water and loosened debris from a sewer catch basin into a vacuum body. Still more particularly the invention relates to sewer and catch basin cleaners which include a filtration system for purifying dirty water and directing the cleaned water into a water tank so that the machine can be operated for longer periods without interruption.

BACKGROUND OF THE INVENTION

A number of different types of sewer cleaners are known to the art. Manual systems are still used in numerous localities and employ buckets dragged through the sewer lines to remove debris.

In recent years, combination sewer and catch basin cleaners have been developed to speed cleaning and to reduce cleaning costs. Many of the machines employ the general concepts of Dougene's U.S. Pat. No. 287,811 issued on Nov. 6, 1883 and entitled "Cleaning Sewers". This patent describes a combination water injection and water pumping machine for flushing a sewer with water and removing the water and collected debris from settling chambers associated with the sewer lines.

More recent developments are described in Parmallee's U.S. Pat. No. 3,600,225 issued Aug. 17, 1971 for "Pipe Cleaning" and Shaddock's U.S. Pat. No. 3,658,589 issued Apr. 25, 1972 for "Catch Basin and Sewer Pipe Cleaner". In both of these patents, water under pressure is injected into sewer laterals through specially designed nozzles to wash debris into a manhole or catch basin.

The nozzles employed in the latter two patents have a plurality of water jets oriented toward the manhole or catch basin after the nozzle is inserted in the lateral. When the water is forced through the jets, the nozzles are driven further into the laterals. When the nozzles are retracted, the jets clean the sewer by a knife-like action and the additional water flushes loosened debris toward the catch basin or manhole.

Parmalee and Shaddock differ primarily in the water injection and water recovery systems. In Parmalee, a screen is placed over a water recovery hose and water is pumped from a manhole into a settling tank, through a grit remover and centrigugal separator to a storage tank for being reused in the cleaning process. Parmalee does not include a vacuum system for removing large solids from the manhole. Shaddock, on the other hand, employs a vacuum system for pneumatically conveying debris and water from the catch basin into a material collection chamber.

While the systems described in these two patents are much more efficient and economical than manual cleaning systems, Parmalee does not employee vacuum loading and Shaddock does not have the capability of water regeneration. Shaddock's machine must be reloaded with water at the beginning of each cleaning operation, or sewer cleaning must be accomplished at a location near a water supply, such as a fire hydrant or water main. This deficiency results in extended downtime, inconvenience and loss of overall efficiency.

An improved sewer and catch basin cleaner is described in U.S. Pat. No. 4,134,174 issued on Jan. 16, 1979 to Flynn and Wurster. The unit described in this patent includes a water tank and a pump and hose connected thereto for supplying water under pressure to the sewer laterals. The unit also includes a body, a vacuum hose and a vacuum pump downstream of the hose and body for vacuum loading water and debris from a manhole or catch basin into the body. The improvements disclosed in this patent include a conduit between the body and water tank, a pump connected to the conduit and filter means located in the body for screening impurities before the water reaches the conduit.

In the preferred embodiment of the Flynn and Wurster patent, two screens are used in the body and a system is provided for cleaning one of the screens by causing air to periodically pass through the screen in a direction which is reverse to that of the water flow. It is also disclosed that a water strainer and centrifugal separator may be employed to provide further purification of the water after it enters the conduit but before it reaches the water tank.

Another improvement disclosed in the Flynn and Wurster patent includes an overfill protection system for the body which includes sensors and a vent for the body when water reaches a preselected height. The vent reduces the negative pressure in the body and prevents further vacuum loading.

Yet another improvement disclosed in the Flynn and Wurster patent is the use of an ejector plate in combination sewer and catch basin cleaners. In addition to providing a convenient way of emptying the body, the disclosed ejector plate acts as yet another filter to separate large particles and prevent them from reaching the two screens. The ejector is moved by a hydraulic ram.

Finally, the Flynn and Wurster patent discloses an elongate boom mounted behind the truck cab but extending thereover, the boom being horizontally rotatable and vertically elevatable and supporting both the water and vacuum hoses. The boom and hose arrangement permits optimum maneuverability of the hoses while minimizing obstruction of streets or highways during cleaning.

While the sewer and catch basin cleaner disclosed in the Flynn and Wurster patent represents a significant advancement in the art, it has been found that water removed during the vacuum operation may exceed the amount of water introduced through the cleaning nozzles. The excess water comes from normal sewer flow and may amount to a trickle or a substantial flow depending on the type of sewer system, the time of day, the amount of recent rainfall, etc. The excess water creates a problem because the loading capacity usually exceeds the capacity of the water filtration system. A manually operated drain was employed in the Flynn and Wurster device but was not satisfactory because the drain could become plugged and the truck would have to be repositioned to dump the water.

Another problem encountered with this type of prior art sewer and catch basin cleaner was the tailgate operation and sealing. Hydraulic cylinders were required to open and close the tailgate adding to the expense of the unit and creating additional sources of repair problems. Moreover, the tailgate gasket for a combination sewer and catch basin cleaner required frequent repair. The seal must prevent leakage and insure sufficient vacuum in the water collection body. Moreover, manufacturing tolerances had to be very close to insure a proper seal.

Inflatable seals are known for several different types of systems known to the present inventor. They are employed in railroad systems to insure a proper seal between freight cars and freight car loading devices. They are also employed on one type of industrial vacuum loader in which a material collection chamber and filter are raised by a hydraulic ram to dump a material collection body. In this device, an inflatable seal is used at the junction of the filter and the vacuum pump assembly.

The present inventor is also aware of a prior art sewer and catch basin cleaner which has a means for pumping water from the collection body when it is filled. In this machine, the pump which is used to create a vacuum inside the collector body is also employed to pump water out of the body and into a hose which may be placed back into the sewer. The water which is removed from the body is dirty water and body emptying cannot be done at the same time that sewer cleaning continues. This system then does not overcome downtime problems in the overall sewer cleaning operation.

OBJECTS OF THE INVENTION

It is a primary object of the present invention to provide a sewer and catch basin cleaner which includes an automatic system for selectively pumping water from a material collection body to a water tank for reuse in sewer cleaning or to a water discharge line.

Another object of the present invention is to provide a sewer and catch basin cleaner in which the selective pumping of water to the reclamation system or discharge line takes place without interrupting sewer cleaning.

A further object of the present invention is to provide a combination sewer and catch basin cleaner which employs an ejector plate for emptying the body through a tailgate and in which the ejector plate and tailgate are interconnected.

Yet another object of the present invention is to provide an improved seal for the tailgate of a combination sewer and catch basin cleaner.

A still further object of the present invention is to provide a sewer and catch basin cleaner in which the water return line to the sewer is mounted on the same boom which normally supports the water injection hose and the vacuum hose.

How these and other objects of the invention are accomplished will be described in the following detailed description of the preferred embodiment of the invention taken in conjunction with the FIGURES. Generally, however, the objects are accomplished by providing a sewer and catch basin cleaner which includes a body and a vacuum system for drawing material out of the manhole or catch basin and depositing it in the body. The cleaner also includes a water tank and a pump and hose system for pumping water from the body to the water tank and a pressure switch and water level detectors for shifting the flow of recycled water from the water tank to a discharge hose when sufficient water is in the water tank. Water from the body passes through a pump and to a three-way valve which is controlled by the level detectors. The sewer cleaner of the present invention also includes an inflatable seal for the machine's tailgate. Finally, the sewer cleaner of the present invention includes a pusher ejector plate in the body for pushing debris out the tailgate. A rod couples the ejector plate and tailgate so that movement of the ejector automatically opens the tailgate. Retraction of the ejector plate seals the tailgate seal.

DESCRIPTION OF THE PREFERRED EMBODIMENT

Figure 1:
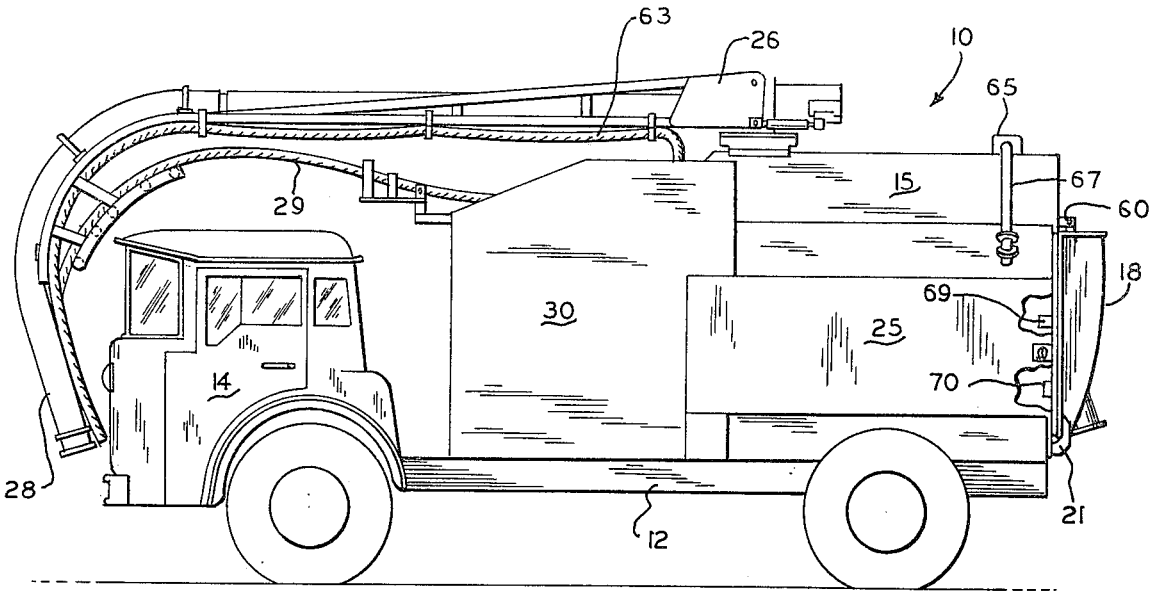
FIG. 1 is a side perspective of a sewer and catch basin cleaner according to the preferred embodiment of the present invention.

FIG. 1 shows in perspective view a sewer and catch basin cleaner 10 according to the preferred embodiment of the present invention. Cleaner 10 is mounted on the chassis 12 of a truck which includes a cab 14. While cleaner 10 is shown mounted on a truck, it should be noted that the cleaner 10 could also be mounted on a trailer or it could be self-propelled, e.g. on a crawler tractor. Accordingly, the description of the present invention in connection with truck mounting should be taken as illustrative rather than limiting.

Figure 1A:
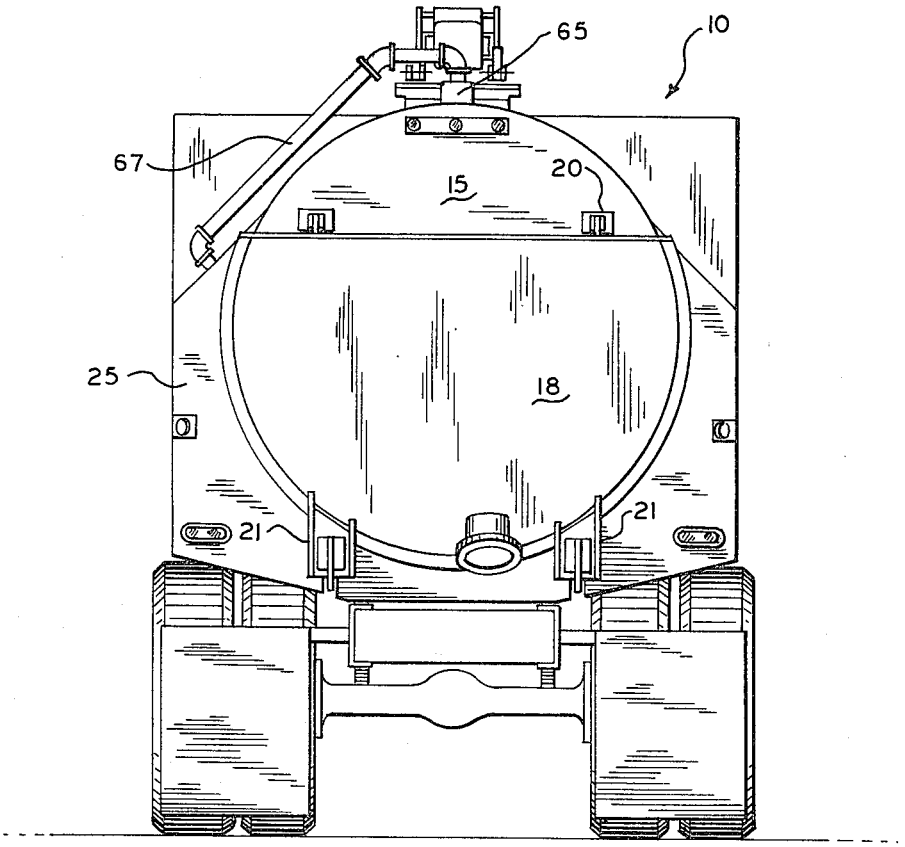
FIG. 1A is a rear perspective of the sewer and catch basin cleaner of FIG. 1.

As seen in FIGS. 1 and 1A, cleaner 10 includes a material collection body 15, which in the illustrated form is generally cylindrical. A tailgate 18 is provided at the rear of body 15, the tailgate being sufficient in size to permit easy removal of debris from body 15. The tailgate is coupled to the rear of body 15 by a pair of spaced-apart hinges 20, so that the tailgate opens upwardly from the bottom. Tailgate locking latches 21 are also illustrated in these two figures and may be of any suitable design. Latches 21 are designed to release the tailgate during body emptying and to exert a positive sealing force against the lower end of tailgate 18 during other phases of machine operation.

Other major features of the sewer and catch basin cleaner 10 include a water tank 25 which surrounds the lower portion of body 15 and a boom 26 which is mounted to the top of body 15. The boom supports a vacuum hose 28 and a water hose 29, the latter being for injection of water under pressure into the sewer laterals. It can be seen from FIG. 1 that manipulation of boom 26 moves both hoses to facilitate positioning the same in the manhole or sewer catch basin. While not shown in detail, it should be appreciated that the boom is vertically elevatable and horizontally rotatable so that the free ends of both hoses can be precisely located for cleaning.

Other operating components of sewer and catch basin cleaner 10 are located behind shroud 30 and will be only briefly described because they do not in and of themselves form part of the present invention. First, a vacuum pump is provided for creating a negative pressure within body 15. The pump preferably is of the positive displacement variety and is coupled to the top of body 15 for drawing an air stream through the vacuum hose 28 to facilitate loading of water and debris. An air filter screen or filter bags may be interposed between the body and the pump to protect the pump from any particulates which could be encountered during loading. Second, a water system behind shroud 30 includes a hose reel for water hose 29 and a water pump for drawing water from tank 25 and forcing it through hose 29 to the cleaning nozzle. The hose reel and boom are adapted for allowing the hose to freely unwind as the nozzle pressure forces the hose into the sewer lateral, and a drive for the hose reel is provided to rewind the hose during that phase of the cleaning operation. While the details of the water injection and vacuum systems have not been described in detail, reference can be had to the aforementioned Flynn and Wurster patent for a more complete written and pictorial description of these systems, and the disclosure of that patent with respect to the two systems is hereby incorporated by this reference.

Figure 2:
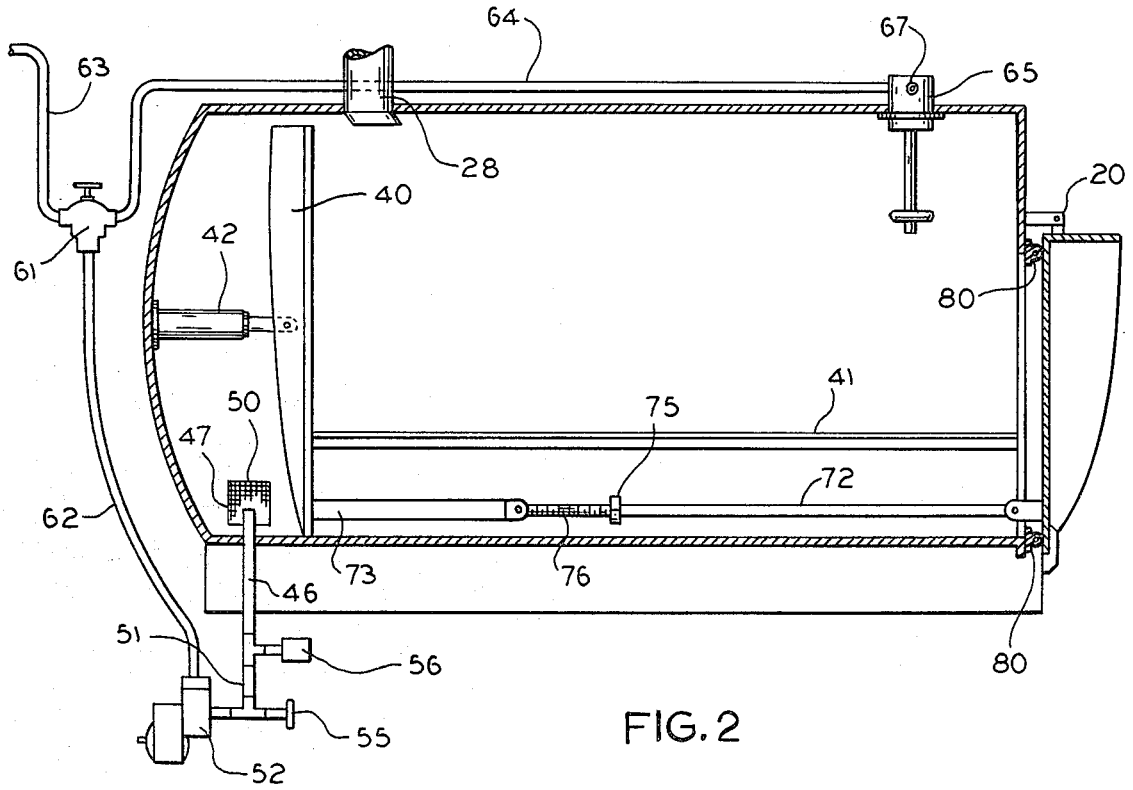
FIG. 2 is a schematic longitudinal cross section through the body of the sewer and catch basin cleaner.

It will also be appreciated, by reference to FIG. 2, that a filtration system is included for filtering the water collected in body 15 to permit a portion of same to be recycled to water tank 25, and preferably the unit includes most of the same basic water filtration elements employed in the aforementioned Flynn and Wurster patent.

Up to five separate filtration elements are provided between the inlet to the body and the water injection nozzles. The first stage filtration is provided by the machine's ejector plate 40 which extends across the body 15 and is movable by hydraulic ram 41 from the front of the body toward the tailgate. Ejector 40 has only a small clearance with the inner walls of body 15 and thereby insures that particles larger than such clearance stay rearwardly of the ejector. Ejector plate 40 moves along a pair of rails 41 mounted on the right and left sides of body 15. A screen cage may be mounted forwardly of the ejector plate 40 to provide a second solid particle barrier. Such a cage is described in the Flynn and Wurster patent but is not shown in the illustration here. If such a cage is used, the screen openings are selected to remove solids which pass by the pusher plate 40, and may be between 1/16" and ¼".

An outlet 46 from body 15 comprises a pipe which extends through the floor of body 15 at a location forwardly of ejector plate 40. A first end 47 of pipe 46 is located within body 15 and is spaced above the floor by several inches. A cylindrical screen 50 surrounds end 47 of pipe 46 so that all water entering the pipe must pass through screen 50. A floating inlet to pipe 46 could also be used. Preferably such a floating inlet would remove water from just below the surface of the water within body 15.

The second end 51 of pipe 46 is coupled to a water recycling pump 52 mounted below the forward end of body 15. Pump 52 may be any type of known water pump, but preferably pump 52 is a hydraulically driven water pump having a capacity of about 100 gallons per minute or more.

Pipe 46 also includes an air inlet valve 55 for admitting air from the atmosphere into pipe 46 at the discretion of the machine operator or at set intervals if an automatic timer is employed. When valve 55 is open, air will enter pipe 46 due to the negative pressure within body 15 and will bubble through the screen cylinder 50 to free same of any blockage or obstruction of the screen pores.

Pipe 46 is also coupled to a differential pressure switch 56 which is designed to measure the liquid level within body 15. This switch is also coupled to pump 52 so that water is drawn from body 15 only when the level within the body exceeds a preselected height.

In the present invention the path of water pumped from body 15 is determined by a three-way valve 61 coupled to a pipe 62 downstream of pump 52. The two outlets of valve 61 comprises hose 63 and pipe 64. Hose 63 extends from valve 61 and travels along boom 26 as a discharge water line. Water passing through this hose will be returned to the sewer from body 15. Pipe 64 on the other hand is coupled to a centrifugal type of particle separator 64 mounted at the top of body 15. Separator 65 is designed to remove fine particulates from water passing therethrough, the particulates being returned to the body 15. The clean water resulting from the separation is returned via pipe 67 (See FIG. 1) to the water tank 25.

To complete the description of the water purification system it can be mentioned that a strainer may be placed in the water outlet from water tank 25.

Control of the 3-way valve 61 is dependent on high and low water level detectors 69 and 70 located within water tank 25. If the water level is below the high level probe 69, the 3-way valve 61 is positioned to route water to the separator 65 and the electrical components are designed to maintain that flow path until the high level probe is submersed in water.

When probe 69 is immersed, the 3-way valve 61 will shift and direct water through hose 63 to discharge. An override is provided so that the machine operator can shut off valve 61 entirely if for some operating reason it is undesirable to discharge back into the sewer. In this event, water will accumulate in body 15.

The system will remain in the discharge (or shut-off) mode until the water level in tank 25 falls below the low level probe 70 at which point the valve 61 again shifts to direct water back to the separator 65.

In typical operation, water may be removed from the water tank at a maximum of about 60 gallons per minute, and the recycling system has a 70–80 gallon per minute capacity. Therefore, the recycling system should always be able to keep ahead of the sewer cleaning water requirements and still have some capacity for removing water from the body and putting it back into the manhole. At times when the discharge system is employed, the capacity of return should be 80–100 gallons per minute because less restriction exists in that circuit than through the separator. If at any time during this procedure the water level in body 15 falls below a preset level as determined by pressure switch 56, the recycling or discharge system will shut down entirely and will not restart until the level is adequate. By way of example, the high and low level probes in tank 25 may represent about 300 gallons and at a usage rate of 60 gallons per minute, approximately 5 minutes of operating time is utilized to return water to the sewer before the three way valve 61 would redirect flow to the separator.

Figure 3:
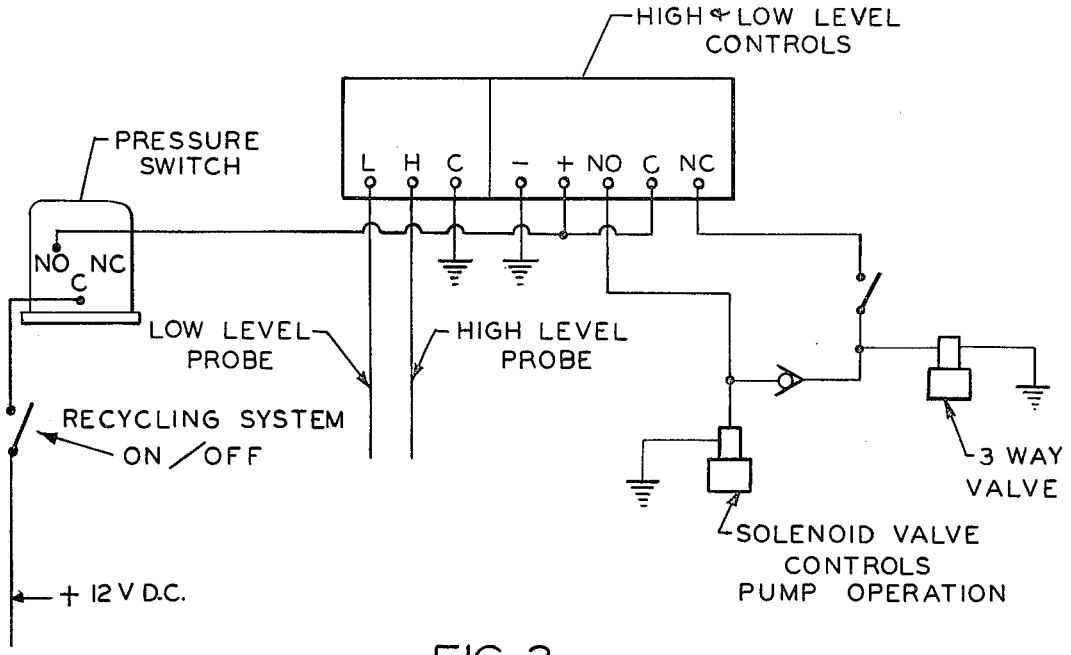
FIG. 3 is an electrical schematic relating to the water recycling and discharge system of the present invention.

An electrical schematic for the recycle-discharge system of the present invention is provided at FIG. 3. The electrical system is shown for purposes of illustration and should not be taken as limiting, as other types of electrical systems could be devised by one skilled in the art after reading the disclosure of the present invention.

The tailgate activation and sealing features of the present invention are shown in FIG. 2.

A tubular steel member 72 is coupled to a bracket 73 attached generally at the bottom of ejector plate 40. Steel tube 72 has a hole in one end which is pivotably attached to a bracket 74 at the inside bottom of tailgate 15, while the other end is formed with a nut 75. The nut receives a treaded rod 76 which in turn is pivotably coupled to bracket 73 on the pusher plate. The threaded rod and nut combination permit proper adjustment of the overall length of steel tube 72 to permit proper opening and closing of tailgate 15. From this description it will be appreciated that the tailgate will be opened about its hinges 20 as the ejector plate is extended. It will also be appreciated that tubular member 72 will move from its horizontal position to an inclined position as the ejector plate approaches the rear of body 15.

It should also be noted that the holes at either end of the link are oversized (for example ¾" holes for ½" pipes). This feature ensures that the link doesn't bind in the mounting holes at the tailgate open or tailgate closed positions.

While not shown in detail it will be apparent that the latches for the tailgate must be released before ejector plate operation. This can be accomplished by providing a separate switch for the latches, if they are hydraulically powered, or by a sequencing device which would open the tailgate just before the ejector plate begins its movement toward the rear of body 15.

FIG. 2 also shows the preferred tailgate seal of the present invention to include a generally tubular gasket 80 which includes a valve assembly having a hose nipple and check valve similar to that found on automobile tires. One example of a suitable gasket is neoprene tube extruded to the desired shape and vulcanized together at its ends. The seal is inflated to about 25 psi. The inflated gasket is attached to and surrounds the body opening even in there are minor manufacturing irregularities. Also, by employing an inflatable tailgate seal, problems of gasket wear and consequent leaks are eliminated.

While the present invention has been described by reference to the illustrated preferred embodiment, it is not to be limited to the illustrated configuration but is to be limited solely by the claims which follow.

What is claimed is:

1. In a combination sewer and catch basin cleaner of the type including water injection and vacuum loading systems, said water injection system comprising a water tank, a water hose and a first pump means for delivering water under pressure through said hose, said vacuum system comprising a body, a vacuum hose and a vacuum pump downstream of said vacuum hose and body for vacuum loading material into said body through said vacuum hose, said cleaner also including recirculation pump means for pumping water from said body into said water tank and filtration means for said water whereby the water tank may be replenished from said body, the improvement in said cleaner comprising:

valve means downstream of said recirculation pump means, said valve means having an inlet and two outlets, discharge hose means coupled to a first outlet, the other of said outlets being coupled by conduit means to said water tank.

2. The invention set forth in claim 1 wherein said water tank includes water level sensing probe means, said probe means being coupled to said valve means for selecting the outlet therefrom.

3. The invention set forth in claim 2 wherein said probe means comprise a high water probe and a low water probe located within said water tank and coupled to said valve means whereby water is directed through said second outlet to said water tank when the water level within said water tank falls to the level of said low water level probe and to direct water through said first outlet and discharge hose means when the water level within said water tank reaches the high water level probe.

4. The invention set forth in claim 1 wherein a pressure switch is coupled to said body and to said recirculation pump means whereby water is pumped to said valve means only at such time as the water level within said body exceeds a preselected level.

5. The invention set forth in claim 1 wherein a separator means is located intermediate said valve means and said water tank and said second outlet is connected thereto, said separator means being capable of removing entrained particulate material from water passing therethrough, said particulates being deposited in said body and water purified by said separator means being directed to said water tank.

6. The invention set forth in claim 5 wherein said separator comprises a centrifugal separator.

7. The invention set forth in claim 1 wherein said cleaner further includes a body opening, a tailgate and an ejector plate means in said body for pushing material from said body through said tailgate, said ejector plate and tailgate being coupled whereby movement of said ejector plate toward said tailgate opens said tailgate.

8. The invention set forth in claim 7 wherein said cleaner further comprises a seal between said tailgate and said body, said seal being inflatable and comprising a tubular elastomeric material.

9. A sewer and catch basin cleaner having a material collection body, said body having a material inlet and an outlet, a tailgate mounted to said body for sealing said outlet, ejector plate means within said body for pushing material from said body through said outlet when said tailgate is open, said ejector plate means and said tailgate being coupled whereby movement of said ejector plate toward said outlet causes said tailgate to open.

10. The invention set forth in claim 9 wherein said tailgate is rotatably mounted to said body by hinge means and wherein said coupling comprises rod means pivotably coupled to said ejector plate means and said tailgate.

11. The invention set forth in claim 10 wherein the length of said rod means is adjustable.

12. The invention set forth in claim 9 wherein an inflatable tube of elastomeric material is provided for sealing said tailgate and said body when said tailgate is closed.

* * * * *